US008316709B2

(12) United States Patent
Grab

(10) Patent No.: US 8,316,709 B2
(45) Date of Patent: Nov. 27, 2012

(54) METHOD AND DEVICE FOR MEASURING FORCE, TORQUE AND OUTPUT ON AN ERGOMETER OR BICYCLE

(75) Inventor: Harald Grab, Hannover (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 288 days.

(21) Appl. No.: 12/674,472

(22) PCT Filed: Jul. 24, 2008

(86) PCT No.: PCT/DE2008/001237

§ 371 (c)(1),
(2), (4) Date: Apr. 9, 2010

(87) PCT Pub. No.: WO2009/026873

PCT Pub. Date: Mar. 5, 2009

(65) Prior Publication Data

US 2011/0179862 A1 Jul. 28, 2011

(30) Foreign Application Priority Data

Aug. 24, 2007 (DE) ..... 10 2007 040 016

(51) Int. Cl.
*A61B 5/22* (2006.01)

(52) U.S. Cl. ..... 73/379.01

(58) Field of Classification Search ..... 73/862.335, 73/862.334, 862.325, 379.01
See application file for complete search history.

(56) References Cited

U.S. PATENT DOCUMENTS 5,027,303 A 6/1991 Witte
5,816,599 A * 10/1998 Soejima et al. ..... 280/259

FOREIGN PATENT DOCUMENTS

DE 31 03 259 A 8/1982
DE 37 22 728 A 12/1988
DE 10 2005 052 445 A 5/2007
EP 0 765 804 A 4/1997

OTHER PUBLICATIONS

2010/0305879 Garb, Dec. 2, 2010.*

* cited by examiner

*Primary Examiner* — Jewel V Thompson
(74) *Attorney, Agent, or Firm* — Lucas & Mercanti, LLP; Klaus P. Stoffel

(57) ABSTRACT

A method and device for measuring force, torque and output on an ergometer or bicycle. When the ergometer or bicycle is used as intended, a torque is transmitted via a shaft onto a flexible drive and further onto the flywheel of an ergometer or the rear wheel of the bicycle by two pedal cranks. The flexible drive has a pulley or a sprocket wheel which is non-rotatably connected to the shaft in at least one direction of rotation. Elastic torsions of the shaft that result independently from the torque transmission are detected at both sides of the pulley or of the sprocket wheel as a measure of the forces applied to the shaft to determine the torque and output both of the left and right leg of the user of the ergometer or bicycle. Corresponding electrical sensor signals are generated and supplied to a memory and/or evaluation unit for further processing.

12 Claims, 1 Drawing Sheet

METHOD AND DEVICE FOR MEASURING FORCE, TORQUE AND OUTPUT ON AN ERGOMETER OR BICYCLE

This application is a 371 of PCT/DE2008/001237 filed Jul. 24, 2008, which in turn claims the priority of DE 10 2007 040 016.2 filed Aug. 24, 2007, the priority of both applications is hereby claimed and both applications are incorporated by reference herein.

FIELD OF THE INVENTION

The invention relates to a method and a device for measuring force, torque and output on an ergometer or bicycle, where, as a result of an intended use of this, torque transmission from two pedal cranks, equipped with pedals, via a shaft to a wrap-around drive and, further on, to an ergometer flywheel or to the rear wheel of the bicycle takes place, and where the wrap-around drive has a belt pulley or a chain wheel which is connected fixedly in terms of rotation to the shaft in at least one direction of rotation.

BACKGROUND OF THE INVENTION

Ergometers and bicycles have been used for a fairly long time as training appliances and/or for rehabilitation, and it is in this case expedient, during the intended use of these appliances, to measure the user's output during training and to evaluate it correspondingly. Complicated solutions for detecting the output involve evaluating the tension in a wrap-around drive, for example a chain, via which the applied force can be determined and from which, in turn, together with a measured angular speed, the output can be arrived at. Reference is made, in this regard, to DE 10 2005 052 445 A1.

Moreover, DE 37 22 728 C1 discloses what is known as an output meter for a crank mechanism of a bicycle, in which the force applied by a person is measured directly on the bottom bracket of the bicycle. The tread force is converted into an electrical signal as a result of the deformation of a suitable flexural element, on which strain gages are applied, and is transmitted by inductive transmission to a receiver connected to the bicycle frame. The tread speed is determined by means of the tread frequency. The two values, namely the tread force and the tread speed, are processed in a microcomputer on the bicycle, displayed and stored or converted into an output.

Furthermore, DE 44 35 174 C2 discloses a device for detecting the applied forces and output on a pedal crank, in particular of a bicycle, a force being determined separately, for both legs of the person applying the force, by measuring the shear strain on the crank pin or on the pedal shaft by means of strain gages arranged thereon.

Finally, it has been known for some time to measure torques of a rotary shaft, with or without a torsion bar, by means of magnetic methods known per se, for example by means of magnetostrictive torque sensors. Magnetostrictive torque sensors of this type are based on the magnetic properties of ferromagnetic materials, for example a tensile stress in the material causing an increase in a magnetic field induced in the material. By contrast, compressive stresses lead to a reduction in the induced magnetic field. A sensor coil fed with alternating current is predominantly used in order to induce the magnetic field into a ferromagnetic torque-transmitting shaft. A secondary pick-up coil or another means monitors the change in the induced magnetic field when the stresses in the shaft change with the torque. The voltage signal induced in the secondary coil is an indicator of the torque.

Thus, for example, DE 34 17 893 A1 describes an arrangement for the contactless detection or contactless measurement of mechanical stress states of machine parts, such as, for example, shafts, by means of a magnetostrictive torque sensor, a layer composed of amorphous magnetostrictive material being arranged on the shaft. Under the influence of mechanical stresses, this layer varies its magnetic permeability, so that, in turn, the inductance of a sensor which is arranged in the vicinity of this layer and comprises at least one coil, is varied. The coating may be sputtered or electrolytically applied to the shaft or be in foil form and be adhesively bonded to the shaft or welded to the latter.

OBJECT OF THE INVENTION

Proceeding from this, the object on which the invention is based is to specify an improved method for measuring force, torque and output on an ergometer or bicycle and a device for carrying it out, which is suitable, at low outlay in measurement terms, for detecting reliable measurement results, specifically separately for both legs of the user who is using the ergometer or bicycle, as intended.

DESCRIPTION OF THE INVENTION

The invention is based on the recognition that conventional measurement methods on ergometers or bicycles, which, in particular, involve stress measurements in the wrap-around drive or force measurements by means of strain gages, are complicated and therefore cost-intensive.

The set object, therefore, is first achieved by means of a method for measuring force, torque and output on an ergometer or bicycle, where, as a result of an intended use of this, torque transmission from two pedal cranks, equipped with pedals, via a shaft to a wrap-around drive and, further on, to an ergometer flywheel or to the rear wheel of the bicycle takes place, and where the wrap-around drive has a belt pulley or a chain wheel which is connected fixedly in terms of rotation to the shaft in at least one direction of rotation. Moreover, according to the method, there is provision whereby elastic torsions of the shaft which result from torque transmission are in each case detected on both sides of the belt pull or of the chain wheel in each case independently of one another, as a measure of the forces applied to the shaft, for the purpose of determining the torque and the output both of the left leg and of the right leg of the user of the ergometer or bicycle, corresponding sensor signals are generated and these are delivered for further processing to a storage and/or evaluation unit.

The values, thus obtained, for the force applied by the user with his right and/or left leg or for the torque acting via the lever length of the pedal crank and for the output furnished per time unit by the user can subsequently be determined and then be displayed on an indicator, stored electronically and/or used for other purposes.

According to an especially advantageous refinement of the method, the elastic torsion of the shaft is detected in each case according to the principle of magnetostriction. In this case, the generated sensor signals may be delivered to the storage and/or evaluation unit electrically or contactlessly.

Moreover, according to the invention, to determine the output furnished by the user with his right and/or left leg, the rotational speed of the shaft is detected and is delivered to the storage and/or evaluation unit, and, in the latter, the output furnished by the user with his right leg and/or with his left leg is calculated by dividing the torque acting on the shaft on the right side and/or on the left side by the measured rotational speed.

In appliance terms, the invention relates to a device for measuring force and output on an ergometer or bicycle, where, as a result of an intended use of the ergometer or bicycle, torque transmission from two pedal cranks, equipped with pedals, via a shaft to a wrap-around drive and, further on, to an ergometer flywheel or to the rear wheel of the bicycle takes place, and where the wrap-around drive has a belt pulley or a chain wheel which is connected fixedly in terms of rotation to the shaft in at least one direction of rotation.

For achieving the set object in respect of the device, there is provision whereby in each case at least one sensor means for the contactless detection of deformations of the shaft in the form of elastic torsions resulting from the torque transmission, as a measure of the forces applied to the shaft, for the purpose of determining the torque and the output both of the left and of the right leg of the user of the ergometer or bicycle, is arranged axially on both sides of the belt pulley or of the chain wheel.

Especially advantageously, these sensor means for measuring the elastic torsion of the shaft are formed in each case by at least one magnetostrictive torque sensor means. The torque sensor means in this case each comprise at least one magnetically coded region on the shaft and at least one sensor coil arranged spaced apart from this. As regards the magnetically coded regions of the shaft, these may be formed by coatings composed of magnetostrictive material which are connected firmly to the shaft or by separate built-on parts composed of magnetostrictive material and firmly connected to the shaft.

Moreover, to determine the output introduced into the ergometer or bicycle by the user, there is provision whereby rotational speed transmitters are arranged on the surface of the shaft and cooperate with a rotational speed sensor which is arranged radially above the rotational speed transmitters and is connected to the storage and/or evaluation unit. During a rotation of the shaft, the rotational speed transmitters moved past the rotational speed sensor generate in the rotational speed sensor a rotational speed signal which is transferred to the storage and/or the evaluation unit.

Advantageously, further, the torque sensor means are connected in each case electrically or contactlessly to an electronic storage and/or evaluation unit for the processing of generated sensor signals of the detected deformations of the shaft.

According to a first advantageous design variant of the device in question, the belt pulley or the chain wheel, together with the sensor means arranged axially on both sides of the belt pulley or of the chain wheel, may be arranged within a region of the shaft which is axially delimited by two bearing points of the latter.

According to a second advantageous design variant, the belt pulley or the chain wheel may also be arranged outside a region of the shaft which is axially delimited by two bearing points of the latter, in which case the sensor means are arranged axially on both sides of the belt pulley or of the chain wheel and at least one sensor means is arranged within said region.

BRIEF DESCRIPTION OF THE DRAWINGS

The invention is explained in more detail below by means of two preferred embodiments, with reference to the accompanying drawings in which.

DETAILED DESCRIPTION OF THE DRAWINGS

Figure 1:
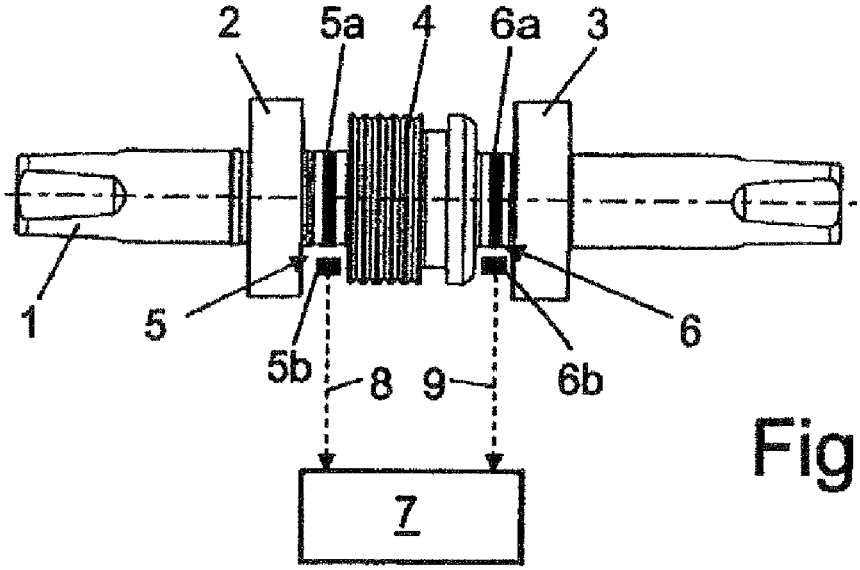
FIG. 1 shows a shaft, designed according to the invention, of an ergometer with a belt pulley arranged between two bearing points and with a measuring device, according to a first embodiment.

The shaft 1, illustrated schematically in FIG. 1, of the bottom bracket of an ergometer known per se, and therefore not shown in detail, allows torque transmission from two pedal cranks, equipped with pedals, via this shaft 1 to a wrap-around drive and, further on, to an ergometer flywheel. The shaft 1 is rotary-mounted by means of rolling bearings at two bearing points 2, 3 in an ergometer frame, not shown in any more detail. In the present case, the wrap-around drive is designed as a belt drive and has a belt pulley 4 which is connected fixedly in terms of rotation to the shaft 1 in at least one direction of rotation.

So that reliable measurement results, specifically for both legs of the user who is using the ergometer, as intended, can be detected separately from one another at little outlay in measurement terms, in each case a sensor means 5 and 6 for the contactless detection of deformations in the form of elastic torsions of the shaft 1 which result from torque transmission, is provided axially on both sides of the belt pulley 4. The sensor-detected elastic torsions constitute a measure of the forces or torques applied to the shaft 1 for the arithmetic determination of the output, furnished per time unit by the user, both of the left and of the right leg of the user of the ergometer.

The measuring means are formed in each case by at least one magnetostrictive torque sensor means 5 and 6 and comprise a magnetically coded region 5*a*, 6*a* on the shaft 1 and at least one sensor coil 5*b*, 6*b* arranged, spaced apart from this. The functioning of magnetostrictive torque sensor means 5, 6 of this type has already been explained in detail initially.

The magnetically coded regions 5*a*, 6*a* are preferably formed by coatings composed of magnetostrictive material which are connected fixedly to the shaft 1. It may, however, also be advantageous, instead, to provide separate, for example, ring-shaped built-on parts composed of magnetostrictive material which are to be connected fixedly to the shaft 1 and which are slipped onto the shaft 1 and connected to the latter nonpositively and/or positively in such a way that the elastic torsions of the shaft 1 which are to be detected are transmitted to the magnetostrictive built-on parts (not illustrated in any more detail).

The torque sensor means 5, 6 or their sensor coils 5*b*, 6*b* are in each case connected electrically or contactlessly, for example by radio or ultrasound, to an electronic storage and/or evaluation unit 7 for the processing of sensor signals 8, 9, generated by the sensor means 5, 6, of the detected deformations or elastic torsions of the shaft 1. The electrical voltage required for this purpose is expediently provided by a stationary electrical network and/or by one or more accumulators.

As shown further in FIG. 1, the belt pulley 4, together with the sensor means 5, 6 arranged axially on both sides of this, is arranged within a region of the shaft 1 which is axially delimited by the two bearing points 2, 3 of the shaft 1, with the result that an arrangement which is extremely compact and in which the required construction space is minimized is afforded.

Figure 2:
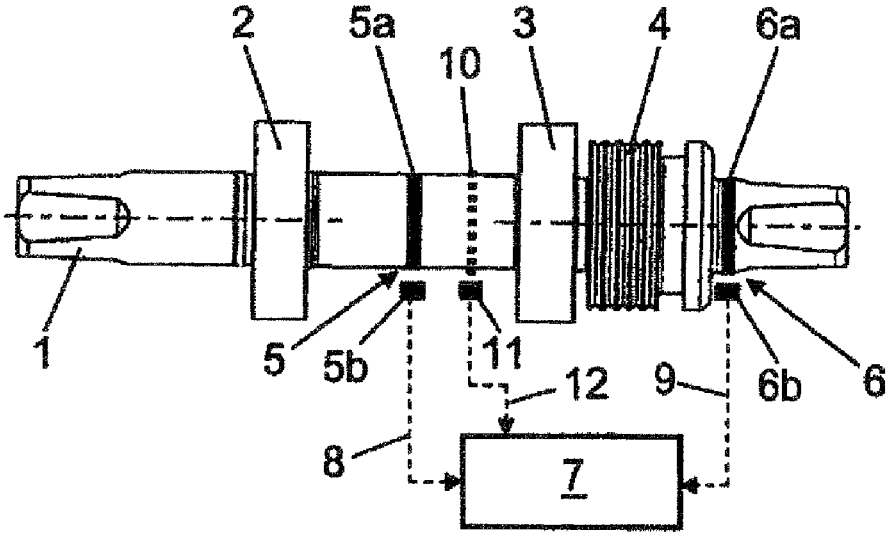
FIG. 2 shows a shaft, designed according to the invention, of an ergometer with a belt pulley arranged outside a region between two bearing points, according to a second embodiment.

The exemplary embodiment illustrated in FIG. 2 differs from the above-described variant essentially in that the belt pulley 4 is arranged axially outside the region included between the two bearing points 2, 3 of the shaft 1, the sensor means 5, 6 likewise being arranged axially on both sides of the belt pulley 4, but at least one of the sensor means 5 being arranged within said region.

Moreover, FIG. 2 shows that magnetic signal transmitters 10 are arranged at a distance from one another on the circumference of the shaft 1 and cooperate with a rotational speed sensor 11 known per se, which is positioned at a radial distance above the rotational speed transmitters 10. When the rotational speed transmitters 10 are moved past under the rotational speed sensor 11 on account of a rotational movement of the shaft 1, the rotational speed sensor records the change in the magnetic field and from this generates a rotational speed signal 12 which is transferred to the storage and/or evaluation unit 7. It is also possible, instead of the measurement principle described, to use other measurement principles for detecting the rotational speed of the shaft 1, for example known optical measurement systems.

With the aid of the torque determined from the recorded torsion of the shaft 1, and of the measured rotational speed of the shaft, the torque applied per time unit on the respective side of the shaft 1 and therefore the user's output furnished in each case can be determined in the storage and/or evaluation unit 7. Knowing the user's output, in particular that furnished by his right and/or left leg, is useful not only for informing the user of the ergometer, but also for the exact setting of the mechanical resistance of the braking device of the ergometer, for example a relevant eddy current brake or band brake.

In ergometers known hitherto, the brake torque or the brake power of the eddy current brake which the user of the ergometer is to counteract or counteracts is estimated from the feed voltage of the eddy current brake with the aid of a mathematically nonproportional relation. Accuracy in this case lies in the range of ±10% around the actual value of the brake torque, which, at least in ergometers to be used diagnostically, is deemed to be insufficient. In such known ergometers, therefore, a calibration of the eddy current brake is usually carried out, in order to find the non-proportional relation between the feed voltage of the eddy current brake and its brake action (brake torque, brake power), and so that the accuracy, required according to a DIN standard, of the brake torque setting or of the torque and output indication can be achieved for the user.

In the measurement system according to the invention, and, in particular, that of FIG. 2, such an outlay is not necessary, since the torque applied and the outputs furnished by the user of the ergometer are determined continuously by means of torque and rotational speed measurement.

The above exemplary embodiments are tailored to an ergometer having a wrap-around drive in the form of a belt drive. However, the invention is not restricted to these exemplary embodiments, but also embraces wrap-around drives in the form of chain drives and also conventional bicycles with a belt or chain drive, which are equipped (not illustrated in any more detail), according to the invention, with the special sensor means 5, 6 for detecting the elastic torsion of the shaft 1 in the region of the bottom bracket when the latter is under load during the intended use, preferably with magnetostrictive torque sensor means 5, 6.

LIST OF REFERENCE NUMERALS

1 Shaft
2 Bearing point
3 Bearing point
4 Belt pulley
5 Sensor means (torque sensor means)
5*a* Magnetically coded region
5*b* Sensor coil
6 Sensor means (torque sensor means)
6*a* Magnetically coded region
6*b* Sensor coil
7 Storage and/or evaluation unit
8 Signal
9 Signal
10 Rotational speed transmitter
11 Rotational speed sensor
12 Rotational speed signal

The invention claimed is:

1. A method for measuring force, torque and output on an ergometer or a bicycle, comprising:

transmitting torque from two pedal cranks, equipped with pedals, via a shaft to a wrap-around drive that has a belt pulley or a chain wheel connected fixedly in terms of rotation to the shaft in at least one direction of rotation, and to an ergometer flywheel or to a rear wheel of the bicycle;

detecting elastic torsions of the shaft, which result from the torque transmission, via a separate sensor arranged axially on each side of the belt pulley or of the chain wheel independently of one another, as a measure of forces applied to the shaft generating corresponding sensor signals; and delivering the sensor signals generated for further processing to a storage and/or an evaluation unit to determine the torque and the output both of a left and a right leg of a user of the ergometer or the bicycle based on the elastic torsions of the shaft detected.

2. The method of claim 1, wherein the elastic torsions of the shaft are detected according to the principle of magnetostriction.

3. The method of claim 1, wherein rotational speed of the shaft is detected and is delivered to the storage and/or the evaluation unit, and an output furnished by the user with the right leg and/or with the left leg is calculated by dividing the torque acting on the shaft on a right side and/or on a left side by the measured rotational speed measured.

4. The method of claim 1, wherein the sensor signals are delivered to the storage and/or evaluation unit electrically or contactlessly.

5. A device for measuring force and output on an ergometer or bicycle, where torque transmission from two pedal cranks, equipped with pedals, via a shaft to a wrap-around drive and, further on, to an ergometer flywheel or to a rear wheel of the bicycle takes place, and where the wrap-around drive has a belt pulley or a chain wheel which is connected fixedly in terms of rotation to the shaft in at least one direction of rotation, wherein a separate sensor for contactless detection of deformations of the shaft in the form of elastic torsions resulting from torque transmission, as a measure of forces applied to the shaft, for the purpose of determining the torque and the output both of a left and of a right leg of a user of the ergometer or the bicycle, is arranged axially on each side of the belt pulley or the chain wheel.

6. The device of claim 5, wherein the separate sensors for measuring the elastic torsions of the shaft are each formed by at least one magnetostrictive torque sensor means.

7. The device of claim 5, wherein the separate sensors each comprise at least one magnetically coded region on the shaft and at least one sensor coil spaced apart from the magnetically coded region.

8. The device of claim 7, wherein the magnetically coded region is formed by coatings composed of magnetostrictive material which are connected fixedly to the shaft or by separate built-on parts composed of magnetostrictive material and fixedly connected to the shaft.

9. The device of claim 5, wherein rotational speed transmitters are arranged on a surface of the shaft and cooperate with a rotational speed sensor which is arranged above the rotational speed transmitters and is connected to a storage and/or evaluation unit.

10. The device of claim 5, wherein the separate sensors are connected electrically or contactlessly to a storage and/or evaluation unit for processing of generated sensor signals of the deformations of the shaft that are detected.

11. The device of claim 5, further comprising two bearing points, wherein the belt pulley or the chain wheel, together with the separate sensors, is arranged within a region of the shaft which is axially delimited by the two bearing points.

12. The device of claim 5, further comprising two bearing points, wherein the belt pulley or the chain wheel is arranged outside a region of the shaft which is axially delimited by the two bearing points, and at least one of the separate sensors is arranged within the region.

* * * * *